US006647656B2

(12) United States Patent
Mazzagetti

(10) Patent No.: US 6,647,656 B2
(45) Date of Patent: Nov. 18, 2003

(54) GUN HOLDING APPARATUS

(76) Inventor: Samuel A Mazzagetti, P.O. Box 12, New Alexandria, PA (US) 15670

( * ) Notice: Subject to any disclaimer, the term of this patent is extended or adjusted under 35 U.S.C. 154(b) by 0 days.

(21) Appl. No.: 09/945,719

(22) Filed: Sep. 5, 2001

(65) Prior Publication Data

US 2003/0041498 A1 Mar. 6, 2003

(51) Int. Cl.[7] ..... F41C 23/00
(52) U.S. Cl. ..... 42/85; 224/150
(58) Field of Search ..... 42/85; 224/931, 224/150, 913; 248/683

(56) References Cited

U.S. PATENT DOCUMENTS

| | | | | | |
|---|---|---|---|---|---|
| 2,463,107 | A | * | 3/1949 | Holroyd | 224/913 |
| 2,808,973 | A | | 10/1957 | Gobble | 224/5 |
| 3,211,351 | A | * | 10/1965 | Sample | 224/150 |
| 3,319,852 | A | | 5/1967 | Perkins | 224/1 |
| 3,441,185 | A | * | 4/1969 | Moomaw | 224/150 |
| 3,495,770 | A | * | 2/1970 | Seltmann, Jr. et al. | 224/150 |
| 3,627,181 | A | * | 12/1971 | Bianchi | 2/247 |
| 3,653,564 | A | | 4/1972 | Carter | 224/1 |
| 3,869,074 | A | * | 3/1975 | Roach | 224/149 |
| 3,927,808 | A | * | 12/1975 | Steen | 224/267 |
| 4,311,263 | A | | 1/1982 | Bianchi | 224/150 |
| 4,361,258 | A | | 11/1982 | Clark | 224/150 |
| 4,384,372 | A | * | 5/1983 | Rector | 2/300 |
| 4,401,246 | A | * | 8/1983 | Dickinson et al. | 224/150 |
| 4,431,122 | A | * | 2/1984 | Garmong | 224/150 |
| 4,493,115 | A | * | 1/1985 | Maier et al. | 2/268 |
| 4,613,067 | A | * | 9/1986 | Gann | 224/150 |
| 4,713,905 | A | | 12/1987 | Dupuy | 42/85 |
| 4,823,998 | A | * | 4/1989 | Johnson | 224/150 |
| 4,827,578 | A | | 5/1989 | Heckerman | 24/265 |
| 4,930,626 | A | * | 6/1990 | Miller | 206/3 |
| 4,976,388 | A | * | 12/1990 | Coontz | 224/150 |
| 5,143,266 | A | * | 9/1992 | Heckerman et al. | 224/150 |
| 5,282,558 | A | * | 2/1994 | Martinez | 224/150 |
| 5,802,756 | A | * | 9/1998 | Hightower | 42/85 |
| 5,806,733 | A | * | 9/1998 | Smith | 224/264 |
| 5,810,219 | A | * | 9/1998 | Rosenfield | 224/149 |
| 5,881,487 | A | * | 3/1999 | Chalker | 42/85 |
| 5,907,918 | A | * | 6/1999 | Langevin et al. | 42/71.01 |
| 5,927,574 | A | * | 7/1999 | Ruesink | 224/149 |
| 5,971,239 | A | * | 10/1999 | Marable | 224/150 |
| 6,125,338 | A | * | 9/2000 | Brienza et al. | 425/4 R |
| 6,279,795 | B1 | * | 8/2001 | Pierzina | 224/150 |

* cited by examiner

*Primary Examiner*—Michael J. Carone
*Assistant Examiner*—Denise J Buckley
(74) *Attorney, Agent, or Firm*—H. Keith Hauger, Esq.

(57) ABSTRACT

A gun holding apparatus consisting of an elongated adjustable support strap having a slidable pad thereon, whereby the slidable support strap is looped in an over and under fashion through a plurality of slit openings in each of two end sections of the slidable pad enabling attachment to the strap of a variety of firearms, including conventional rifles, shotguns and muzzleloaders. A gun holding apparatus is provided for safety in holding rifles, shotguns and muzzleloaders in a carrying position, resting position, and at the same time, making for an easy and quick shift of a firearm from the resting position to a ready position for shooting without any adjustment to the gun holding apparatus.

20 Claims, 6 Drawing Sheets

GUN HOLDING APPARATUS

BACKGROUND OF THE INVENTION

1. Field of the Invention

The present invention relates to a gun holding apparatus for receiving conventional rifles, shotguns, muzzleloaders and other firearms designed to adjust to different lengths and to be used in a carrying position, resting position and from a resting position quickly and easily raised to a ready position for shooting. More particularly, the invention relates to an elongated adjustable support strap having a slidable pad which may be adjusted to a number of fixed positions for resting on a shoulder or around the neck of a hunter.

2. Description of the Prior Art

U.S. Pat. No. 5,802,756 issued to Hightower on Sep. 8, 1998, discloses a firearm sling constructed with an elongated pad having at one end a thumb loop. U.S. Pat. No. 3,319,852 issued to Perkins on May 16, 1967, is a conventional gun sling featuring thistle-cloth fasteners sold under the trademark "Velcro" located at the face of the strap. Another gun sling and method of use is disclosed in U.S. Pat. No. 3,653,564 issued to Carter on Apr. 4, 1972, which emphasizes a lower end cup for supporting a muzzle with a sling passing around the body of a shoe. A gun sling with a thumb support is shown in U.S. Pat. No. 4,311,263 issued to Bianchi on Jan. 19, 1982. Featured in U.S. Pat. No. 4,361,258 issued to Clark on Nov. 30, 1982, is a locking ring for adjustment on a general carrying strap applicable to various objects. The slings disclosed in the prior art are not as readily adaptable for quick access from the safety position to the shooting position as is shown in the within gun holding apparatus. Thus, the within invention directs itself to an improved gun holding apparatus that is safer to use, yet functions more efficiently in allowing the firearm to be raised to a firing position.

SUMMARY OF THE INVENTION

It is, therefore, an object of the present invention to eliminate the problems inherent with existing known slings for holding rifles, shotguns, muzzleloaders and the like which holding apparatus can selectively be placed in a carrying position, resting position or ready position for shooting.

Another object of the present invention is to provide a gun holding apparatus that is easily adjustable in length in order to accommodate various types of firearms of all dimensions, shapes and sizes.

It is the further object of the present invention to eliminate use of a swivel, and thus, same has been constructed of less components for simplifying the manufacturing process and making for more economical production.

Yet another object of the present invention is to create a gun holding apparatus that won't slide once positioned on the shoulder or around the neck making for a safer use.

Another object of the present invention is to create a safer gun holding apparatus, in particular, during the resting position leaving the hands free for other important purposes.

Another object of the present invention is to create a gun holding apparatus which when same is in the resting position is pointed away from the body, and at the same time, enables the gun to be easily and quickly raised to the shooting position.

An aesthetic object of the present invention is to produce a gun holding apparatus with a pad that may have imprinted thereof on an outer exposed surface a design, lettering, name or the like.

More specifically, the present invention is a gun holding apparatus for receiving conventional rifles, shotguns, and muzzleloaders, comprising an elongated adjustable support strap consisting of opposing looped ends for attachment to said rifles, shotguns and muzzleloaders; a slidable pad for movement along said strap, enabling adjustment to a multiple number of fixed positions, whereby at any of said fixed positions, said pad is secured by a first plurality of slit openings at a first end of said pad and a second plurality of slit openings at a second end of said pad, whereby said strap is looped outward and back inward in an over and under fashion with respect to said pad, such that an inward surface of said strap contacts an outward surface of said pad, said strap secured to one of said fixed positions by tightening said strap within said first plurality of slit openings and said second plurality of slit openings; a first of said looped ends created by a releasable tension lock at a first end of said strap creating a strap loop for attachment to a stock section of said rifles, shotguns and muzzleloaders; a second of said looped ends created by a releasable slip lock at a second end of said strap for adjustment of a sling loop for attachment to a butt section of said rifles, shotguns and muzzleloaders.

These objects, as well as other objects and advantages of the present invention will become apparent from the following description, and referenced to the illustrations appended hereto.

BRIEF DESCRIPTION OF THE DRAWINGS

For a better understanding of the invention, reference may be had to the accompanying drawings in which.

DETAILED DESCRIPTION OF THE PREFERRED EMBODIMENTS OF THE SUBJECT INVENTION

Figure 1:
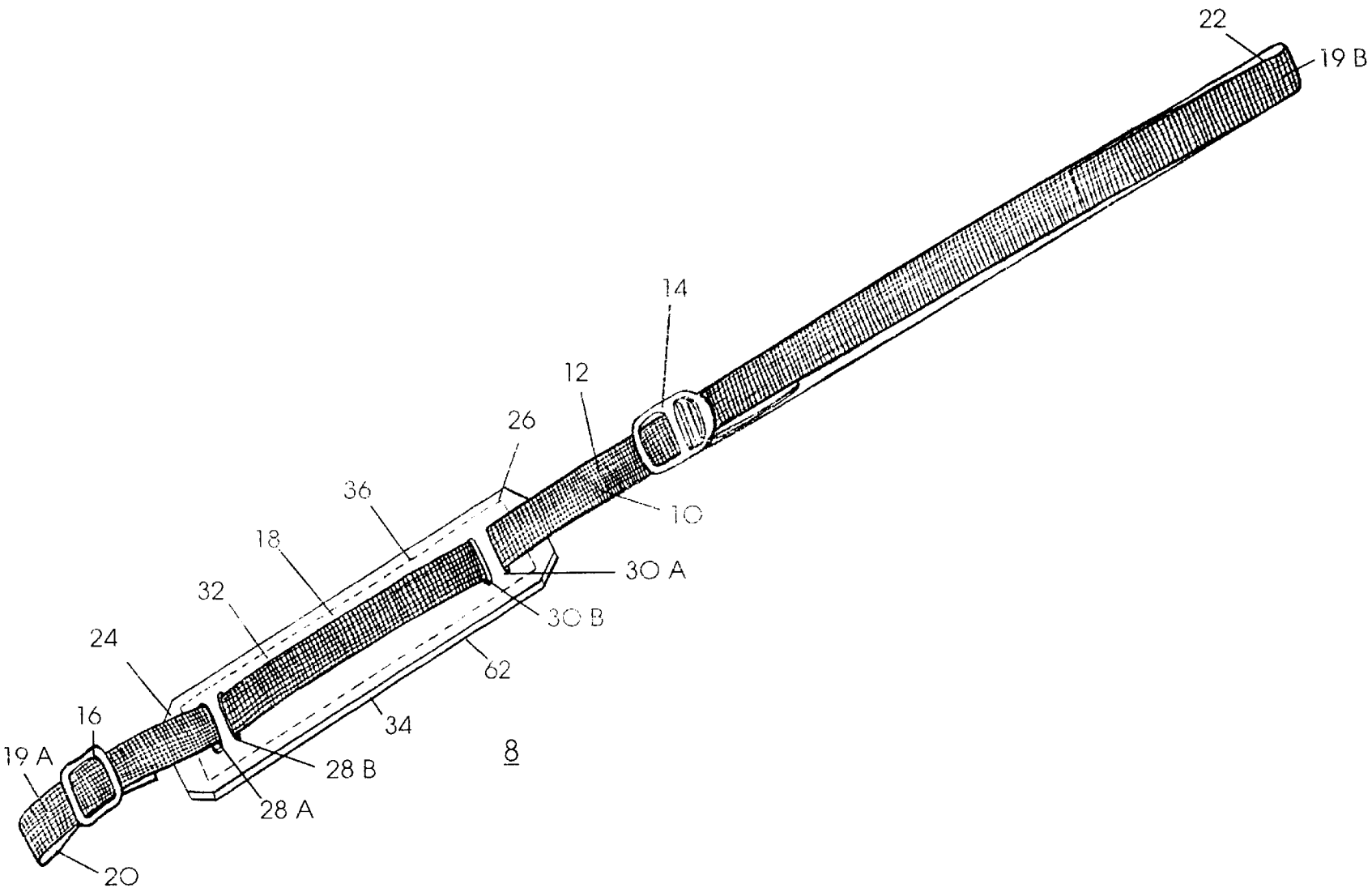
FIG. 1 is a top perspective view of a gun holding apparatus illustrating a four slit slidable pad.

FIG. 1 illustrates a gun holding apparatus 8 shown in an elongated position with its essential components, including an elongated adjustable support strap 10 consisting of a stock loop 20 for holding the stock of a gun 42 and a butt sling 22 for holding the butt 44 of gun 42. Stock loop 20 consists of looping a first end 19A of sliding elongated adjustable support strap 10 through a slip lock 16. Butt sling 22 consists of looping a more lengthy segment of elongated adjustable support strap 10 at a second end 19B through a tension lock 14. Thus, stock loop 20 and butt sling 22 are pulled taut through slip lock 16 and tension lock 14, respectively.

Elongated adjustable support strap 10 is preferably constructed of an interwoven fabric 12 fabricated from a variety of materials including but not limited to polyester, polypropylene, nylon or other like materials. Leather may also be used to construct elongated adjustable support strap 10.

A slidable pad 18 as shown in FIG. 1 is secured to elongated adjustable support strap 10 through slit opening 28A and slit opening 28B at a first pad end 24 of slidable pad 18, and likewise, at a second pad end 26 of slidable pad 18 through slit opening 30A and slit opening 30B. Slidable pad 18 in its preferred embodiment consists of at least two cooperative opposing quadrilateral layers of flexible material being outer pad panel 32 and inner pad panel 34 which may be attached preferably through stitching 36. Slidable pad 18 is preferably constructed from leather, but a variety of materials including burlap, cloth and denim may be used.

Figure 2:
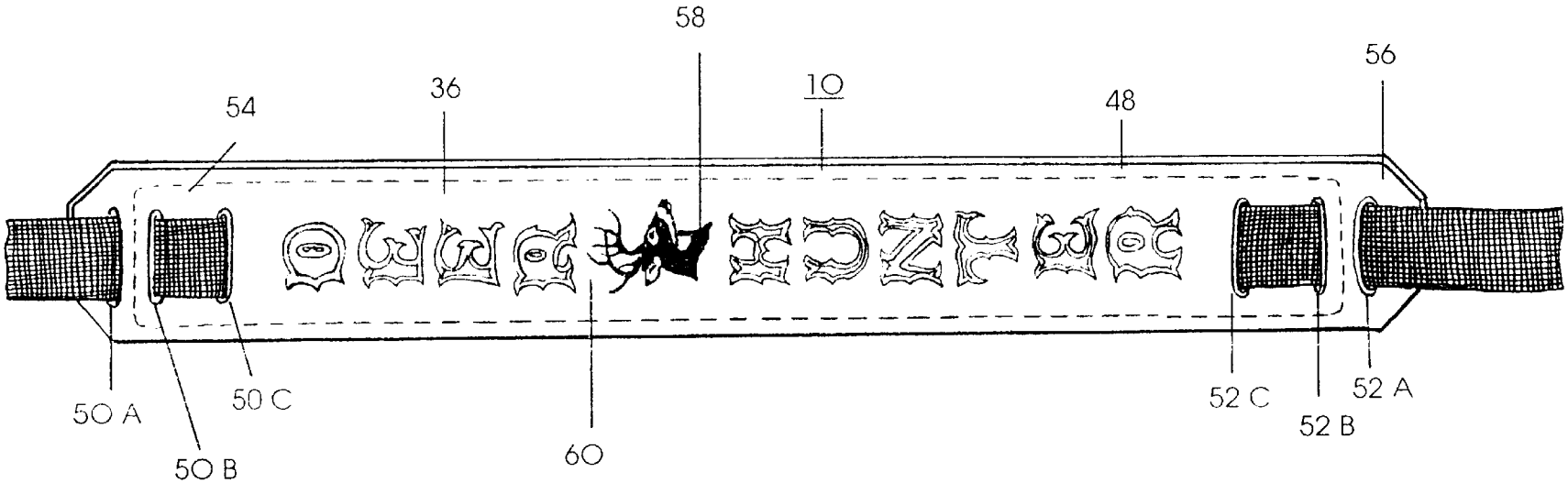
FIG. 2 is a top elevational view of a gun holding apparatus cut away at both ends featuring a pad with six slits enabling a design, lettering, name or the like to be imprinted on an upper face.
Figure 3:
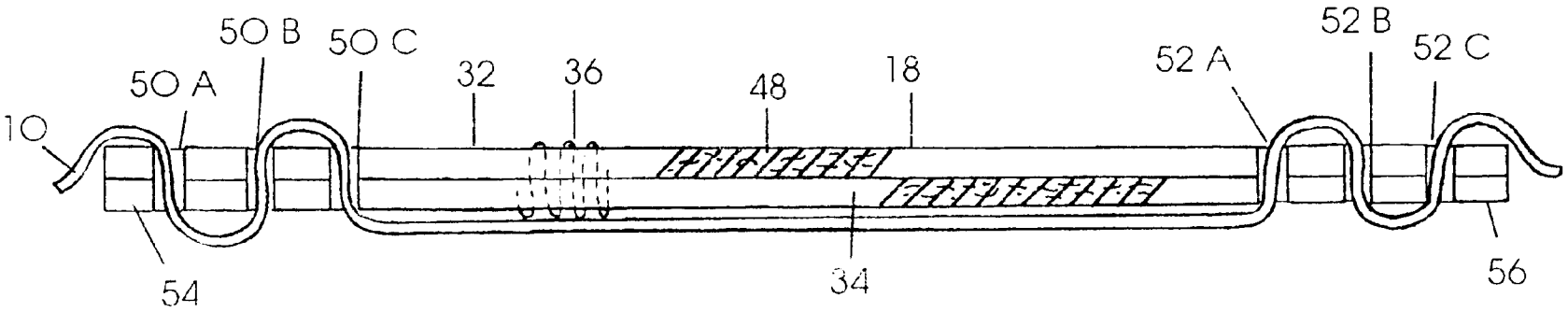
FIG. 3 is a cross section elevational view of a gun holding apparatus illustrating a six slit slidable pad.

FIG. 2 illustrates another embodiment of elongated adjustable support strap 10 having a six slit slidable pad 48. Six slit slidable pad 48 consists of slit opening 50A, slit opening 50B, and slit opening 50C at first pad end 54 for six slit slidable pad 54 and slit opening 52A, slit opening 52B, and slit opening 52C at second pad end 56 for six slit slidable pad 56. This unique design of six slit slidable pad 48 allows for imprinting of a design, lettering, names and the like 58 on outer pad panel 60. FIG. 3 further illustrates a cross section elevational view of six slit slidable pad 48 showing more specifically the manner in which elongated adjustable support strap 10 loops through slit 50A, slit 50B, and slit 50C at first pad end 54 and slit 52A, slit 52B, and slit 52C at second pad end 56.

FIG. 3 indicates that six-slit slidable pad 48 may be imprinted with a design, lettering, names and the like 58 on outer pad panel 32. Thus, it is seen that design, lettering, names and the like 58 are optional features with slidable pad 48 having slit opening 50A, slit opening 50B, slit opening 50C, slit opening 52A, slit opening 52B, and slit opening 52C. Slidable pad 18 represents a preferred embodiment, because it allows for inner surface 62 to have direct contact with a shoulder, neck or other part of the body.

Although slidable pad 18 is shown with outer pad panel 32 and inner pad panel 34, slidable pad 18 may also be constructed of only one layer of material, but in any case, the inner surface 62 of slidable pad 18 having contact with a shoulder, neck or other part of the body will be constructed with a low coefficient of friction to prevent slipping of said elongated adjustable support strap 10. For example, when slidable pad 18 is constructed from leather, inner surface 62 will retain a natural grain of leather to prevent slidable pad 18 from slipping from the shoulder or neck.

Figure 4:
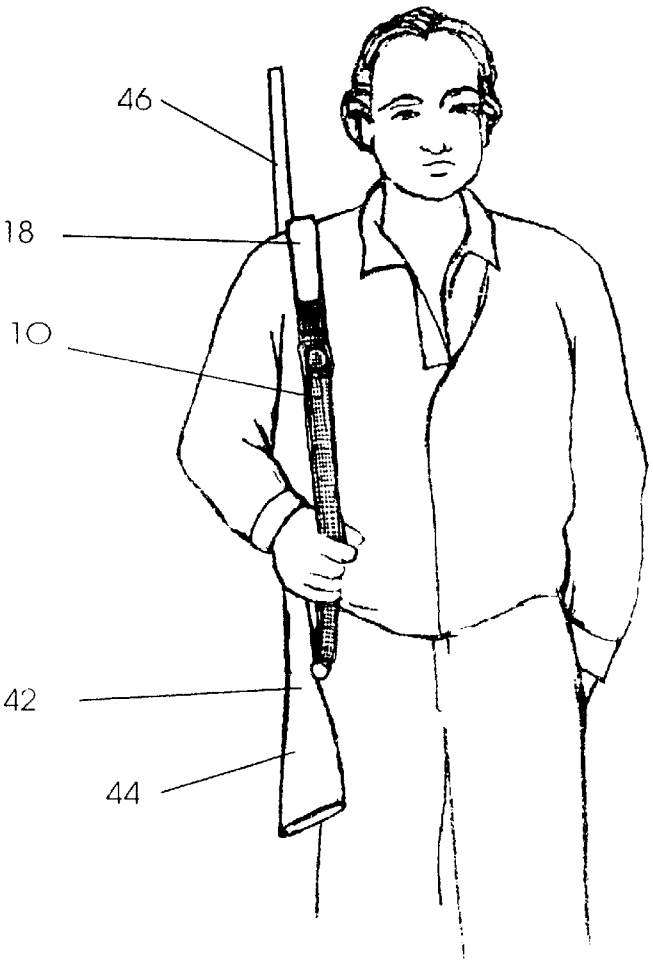
FIG. 4 is a perspective view of a gun holding apparatus for receiving conventional rifles, shotguns and muzzleloaders shown in a carrying position.

Gun holding apparatus 8 is shown in a carrying position in FIG. 4. In this position, slidable pad 18 is seen in contact with the hunter's shoulder allowing stock 46 to be in a vertical position opposite butt 44 providing a position of safety.

Figure 5:
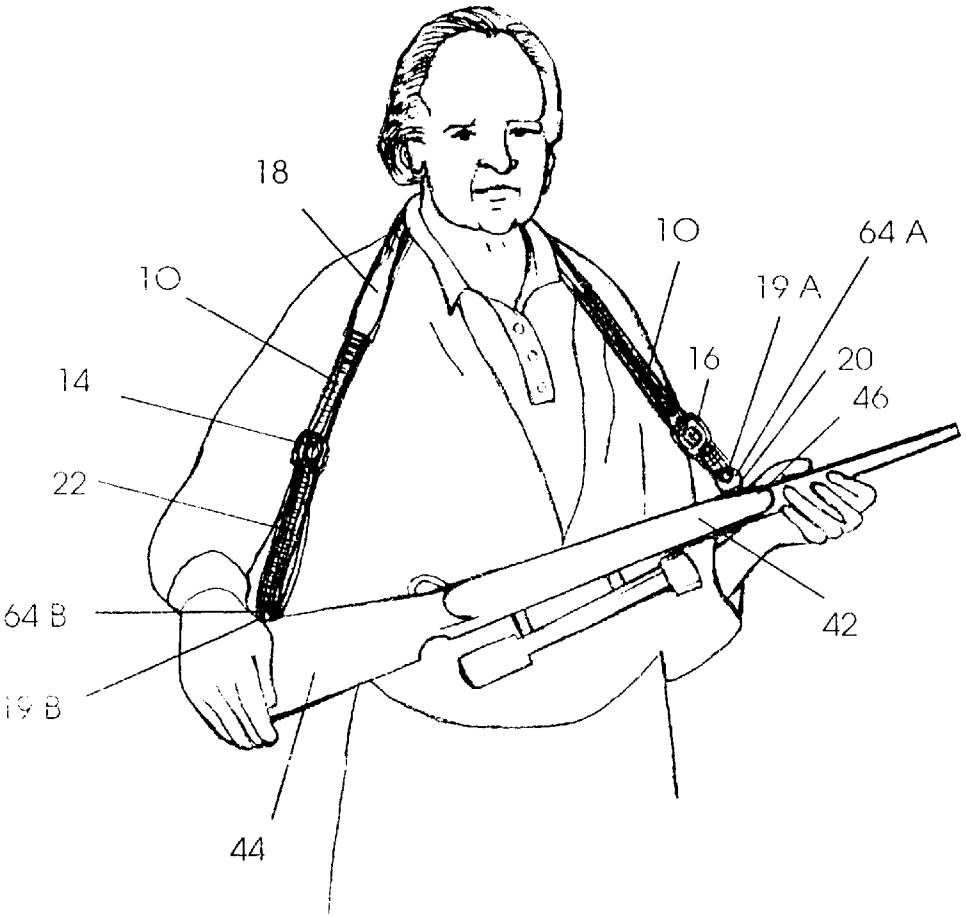
FIG. 5 is a perspective view of a gun holding apparatus for receiving conventional rifles, shotguns and muzzleloaders shown in a resting position with the slidable pad on the back neck and hands free.
Figure 6:
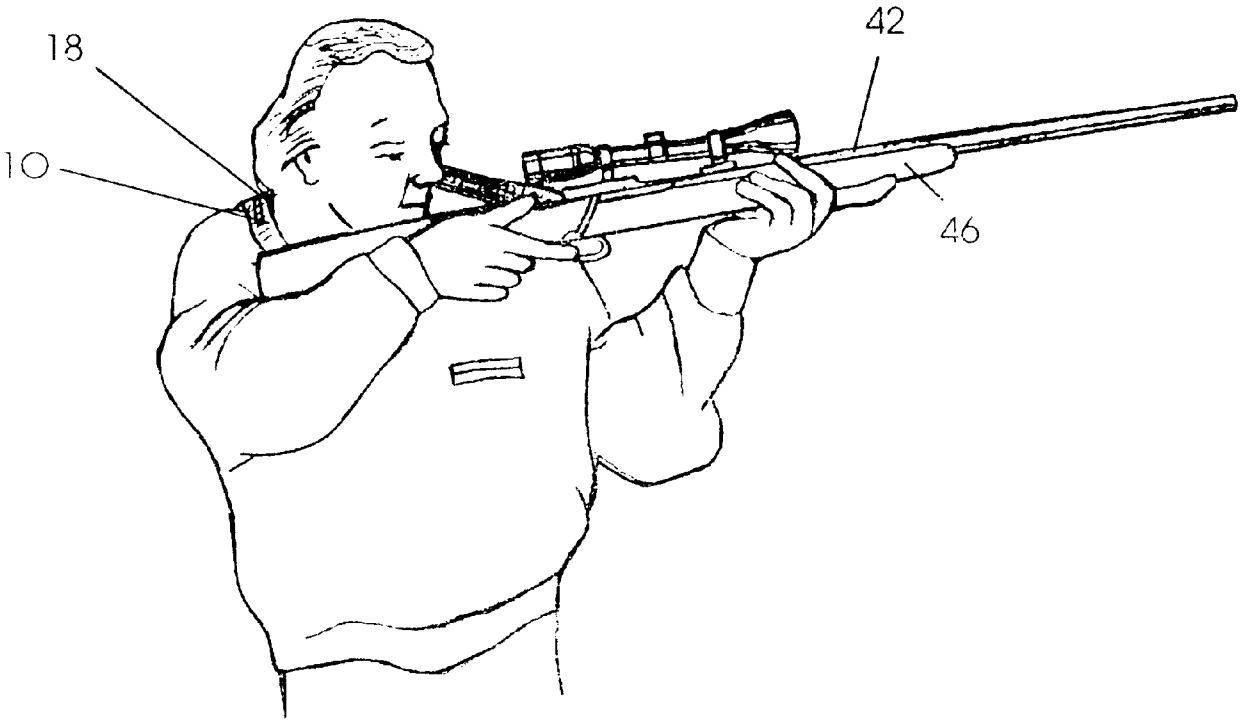
FIG. 6 illustrates a gun holding apparatus for receiving conventional rifles, shotguns and muzzleloaders which has been quickly and easily raised from a resting position to a ready position for shooting.

From the vertical carrying position, a hunter may easily shift gun holding apparatus 8 to the resting position shown in FIG. 5. In the resting position, slidable pad 18 is secured around the neck of a hunter allowing the hands to be free and creating a position of safety. A significant advantage of gun holding apparatus 8 is seen in FIG. 5 and FIG. 6, whereby gun 42 may be easily raised from the resting position to a ready position for shooting without ever making any adjustment or changing of position to gun holding apparatus 8.

FIG. 5 is illustrative of gun holding apparatus 8 in a safe resting position. It is seen that gun 42 has located on stock 46 a stock sling loop 64A, and likewise, on butt 44 a butt sling loop 64B. Stock sling loop 64A allows for stock loop 20 to be attached securely to gun 42 at stock 46 and butt sling 22 is likewise attached to butt sling loop 64B.

I claim:

1. A gun holding apparatus for receiving conventional rifles, shotguns and muzzleloaders, comprising:

an elongated adjustable support strap consisting of opposing looped ends, each for connecting to separated sling loops mounted to said rifles, shotguns and muzzleloaders, enabling attachment to said rifles, shotguns and muzzleloaders;

a slidable pad for movement along said elongated adjustable support strap, enabling adjustment to a multiple number of fixed positions, whereby at any of said fixed positions, said slidable pad is secured by a first set of two slit openings consisting of slit one and slit two located at a first end of said slidable pad and a second set of two slit openings consisting of slit three and slit four located at a second opposing end of said slidable pad, whereby in commencing at an outside portion relative to a user of said slidable pad, said elongated adjustable support strap is looped inward through said slit one toward said user and back outward through said slit two away from said user in an over and under fashion with respect to said slidable pad, such that an inward surface relative to said user of said elongated adjustable support strap contacts an outward surface relative to said user of said slidable pad between said first set of two slit openings and said second set of two slit openings, said elongated adjustable support strap is further looped through said slit three toward said user and back outward through said slit four away from said user in said over and under fashion with respect to said slidable pad, said elongated adjustable support strap being secured to one of said fixed positions by tightening said elongated adjustable support strap within said first set of two slit openings and said second set of two slit openings;

a first of said looped ends created by a releasable tension lock at a first end of said elongated adjustable support strap creating a first strap loop for attachment through a first of said sling loops, being a butt sling loop secured to a butt section of said rifles, shotguns and muzzleloaders;

a second of said looped ends created by a releasable slip lock at a second end of said elongated adjustable support strap creating a second strap loop for attachment through a second of said sling loops, being a stock sling loop secured to a stock section of said rifles, shotguns and muzzleloaders.

2. A gun holding apparatus for receiving conventional rifles, shotguns and muzzleloaders according to claim 1, wherein said slidable pad consists of at least two cooperative opposing quadrilateral layers of flexible material constructed and arranged relative to each other to form said slidable pad for resting on a shoulder.

3. A gun holding apparatus for receiving conventional rifles, shotguns and muzzleloaders according to claim 2, wherein said cooperative opposing quadrilateral layers are joined to each other by a fastening means.

4. A gun holding apparatus for receiving conventional rifles, shotguns and muzzleloaders according to claim 3, wherein said fastening means consists of stitching.

5. A gun holding apparatus for receiving conventional rifles, shotguns and muzzleloaders according to claim 4, wherein one of said cooperative opposing quadrilateral layers has an inner surface relative to said user for contact with said user, said inner surface having a high co-efficient of friction to prevent slipping of said elongated adjustable support strap.

6. A gun holding apparatus for receiving conventional rifles, shotguns and muzzleloaders according to claim 5, wherein said slit openings are arranged in spaced parallel fashion.

7. A gun holding apparatus for receiving conventional rifles, shotguns and muzzleloaders according to claim 6, wherein said gun holding apparatus functions to hold said rifles, shotguns and muzzleloaders in a carrying position.

8. A gun holding apparatus for receiving conventional rifles, shotguns and muzzleloaders according to claim 7, wherein said gun holding apparatus functions to hold said rifles, shotguns and muzzleloaders in a resting position with said slidable pad looped around a neck leaving hands to be free creating a position of safety.

9. A gun holding apparatus for receiving conventional rifles, shotguns and muzzleloaders according to claim 8, enabling said rifles, shotguns and muzzleloaders to be lifted from said resting position to a ready position for shooting.

10. A gun holding apparatus for receiving conventional rifles, shotguns and muzzleloaders, comprising:

an elongated adjustable support strap consisting of opposing looped ends each for connecting to separated sling loops mounted to said rifles, shotguns and muzzleloaders enabling attachment to said rifles, shotguns and muzzleloaders;

a slidable pad consisting of at least two cooperative opposing quadrilateral layers of flexible material joined to each other by stitching along a perimeter of said slidable pad, constructed and arranged relative to each other to form said slidable pad for resting on a shoulder, said slidable pad designed to enable adjustment to a multiple number of fixed positions, whereby at any of said fixed positions, said slidable pad is secured by a first set of two slit openings at a first end of said slidable pad and a second set of two slit openings at a second opposing end of said slidable pad, whereby in commencing at an outside surface relative to a user of said slidable pad, said elongated adjustable support strap is looped inward toward said user and back outward away from said user through said first and second set of slit openings in an over and under fashion with respect to said slidable pad, such that an inward surface facing toward said user of said elongated adjustable support strap contacts an outward surface facing away from said user of said slidable pad along a longitudinal center line, said elongated adjustable support strap secured to one of said fixed positions by drawing taut said elongated adjustable support strap within said first set of slit openings and said second set of slit openings, wherein said slidable pad is constructed such that one of said cooperative opposing quadrilateral layers has an inner surface relative to said user coming into contact with said user and having a high co-efficient of friction to prevent slipping of said elongated adjustable support strap from a shoulder or neck;

a first of said looped ends created by a releasable tension lock at a first end of said elongated adjustable support strap creating a first strap loop for connecting through a butt sling loop secured to a butt section of said rifles, shotguns and muzzleloaders enabling attachment to said butt section of said rifles, shotguns and muzzleloaders;

a second of said looped ends created by a releasable slip lock at a second end of said elongated adjustable support strap creating a second strap loop for connecting through a stock sling loop secured to a stock section of said rifles, shotguns and muzzleloaders enabling attachment to said stock section of said rifles, shotguns and muzzleloaders.

11. A gun holding apparatus for receiving conventional rifles, shotguns and muzzleloaders according to claim 10, wherein said cooperative opposing quadrilateral layers are joined to each other by stitching along a perimeter of said slidable pad.

12. A gun holding apparatus for receiving conventional rifles, shotguns and muzzleloaders according to claim 10, wherein said slit openings are arranged in spaced parallel fashion perpendicular to a longitudinal center line of said elongated adjustable support strap.

13. A gun holding apparatus for receiving conventional rifles, shotguns and muzzleloaders according to claim 10, wherein said gun holding apparatus functions to hold said rifles, shotguns and muzzleloaders in a carrying position with said slidable pad positioned on said shoulder.

14. A gun holding apparatus for receiving conventional rifles, shotguns and muzzleloaders according to claim 13, wherein said gun holding apparatus functions to hold said rifles, shotguns and muzzleloaders in a resting position with said slidable pad looped around a neck leaving hands to be free creating a position of safety.

15. A gun holding apparatus for receiving conventional rifles, shotguns and muzzleloaders according to claim 14, enabling said rifles, shotguns and muzzleloaders to be lifted from said resting position to a ready position for shooting without any adjustment to said gun holding apparatus.

16. A gun holding apparatus for receiving conventional rifles, shotguns and muzzleloaders according to claim 11, wherein said slit openings are arranged in spaced parallel fashion perpendicular to said longitudinal center line.

17. A gun holding apparatus for receiving conventional rifles, shotguns and muzzleloaders according to claim 16, wherein said gun holding apparatus functions to hold said rifles, shotguns and muzzleloaders in a carrying position with said slidable pad positioned on said shoulder.

18. A gun holding apparatus for receiving conventional rifles, shotguns and muzzleloaders according to claim 17, wherein said gun holding apparatus functions to hold said rifles, shotguns and muzzleloaders in a resting position with said slidable pad looped around a neck leaving hands to be free creating a position of safety.

19. A gun holding apparatus for receiving conventional rifles, shotguns and muzzleloaders according to claim 17, wherein said gun holding apparatus functions to hold said rifles, shotguns and muzzleloaders in a resting position with said slidable pad looped around said neck leaving said bands to be free to easily raise said rifles, shotguns and muzzleloaders to a ready position for shooting without any adjustment to said gun holding apparatus.

20. A gun holding apparatus for receiving conventional rifles, shotguns and muzzleloaders according to claim 19, wherein said inner surface of said one cooperative opposing quadrilateral layers is constructed of leather, whereby said inner surface retains a natural grain of leather to prevent said slipping of said elongated adjustable support strap from shoulder or neck.

* * * * *